US006736603B2

(12) United States Patent
Chang

(10) Patent No.: US 6,736,603 B2
(45) Date of Patent: May 18, 2004

(54) OIL SUCTION PUMP

(76) Inventor: Ching-Tsung Chang, No. 151-1, Fwu Tay St., U Ryh Hsiang, Taichung Hsien (TW)

( * ) Notice: Subject to any disclaimer, the term of this patent is extended or adjusted under 35 U.S.C. 154(b) by 17 days.

(21) Appl. No.: 10/170,441

(22) Filed: Jun. 14, 2002

(65) Prior Publication Data

US 2003/0231964 A1 Dec. 18, 2003

(51) Int. Cl.[7] ..... F04F 5/48

(52) U.S. Cl. ..... 417/182.5; 417/187; 417/36; 417/40

(58) Field of Search ..... 417/182.5, 187, 417/36, 40

(56) References Cited

U.S. PATENT DOCUMENTS 853,850 A * 5/1907 Woodall ..... 417/182.5
2,756,682 A * 7/1956 Dinkelkamp ..... 417/297.5
3,570,532 A * 3/1971 Lendino ..... 137/558
3,644,691 A * 2/1972 Suzuki ..... 200/84 R
6,558,138 B2 * 5/2003 Tseng ..... 417/374

* cited by examiner

*Primary Examiner*—Justine R. Yu
*Assistant Examiner*—Michael K. Gray
(74) *Attorney, Agent, or Firm*—Dennison, Schultz, Dougherty & Macdonald

(57) ABSTRACT

An oil suction pump includes a push switch, a shaft vertically located below the push switch, and a float arm horizontally located below the shaft. A hooked lower end of the shaft is adapted to detachably engage with a hooked first end of the float arm and thereby holds the shaft in a fixed position when the push switch is depressed. A second end of the float arm is pivotally connected to a float that ascends when the oil sucked into a container connected to the oil suction pump reaches a predetermined level and thereby causes the first end to descend and disengage from the hooked lower end of the shaft, allowing the latter to move upward into an original position and automatically close an air inlet valve of the oil suction pump.

6 Claims, 5 Drawing Sheets

OIL SUCTION PUMP

BACKGROUND OF THE INVENTION

The present invention relates to an oil suction pump, and more particularly to an oil suction pump having a float that ascends when the oil sucked by the pump into a container reaches a predetermined level and thereby enables automatic close of an air inlet valve of the oil suction pump.

There are various types of oil suction pumps available in the market. Most of these conventional oil suction pumps are structured to prevent the sucked oil from being jetted out via an air cutlet of the pumps in the course of sucking oil, and they do not automatically close their air inlet valve when the sucked oil has reached a preset level in a container connected to the pump. A user must keep watching the oil suction pump when the same is operating to ensure that all the oil has been sucked into the container and then manually closes a handle switch on the pump. This is, of course, very inconvenient for the user to do so. Moreover, these conventional oil suction pumps have complicate structure and require high manufacturing cost and therefore fail to meet most consumers' economical requirements.

It is therefore tried by the inventor to develop an improved oil suction pump to eliminate the drawbacks existing in the conventional oil suction pumps.

SUMMARY OF THE INVENTION

The oil suction pump according to the present invention includes a push switch, a shaft vertically located below the push switch, and a float arm horizontally located below the shaft. The shaft has a hooked lower end that is adapted to detachably engage with a hooked first end of the float arm and thereby holds the shaft in a fixed position when the push switch is depressed. A second end of the float arm is connected to a float that ascends when the oil sucked into a container connected to the oil suction pump reaches a predetermined level and thereby causes the first end of the float arm to descend and disengage from the hooked lower end of the shaft, allowing the latter to move upward into an original position and automatically close an air inlet valve of the oil suction pump.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
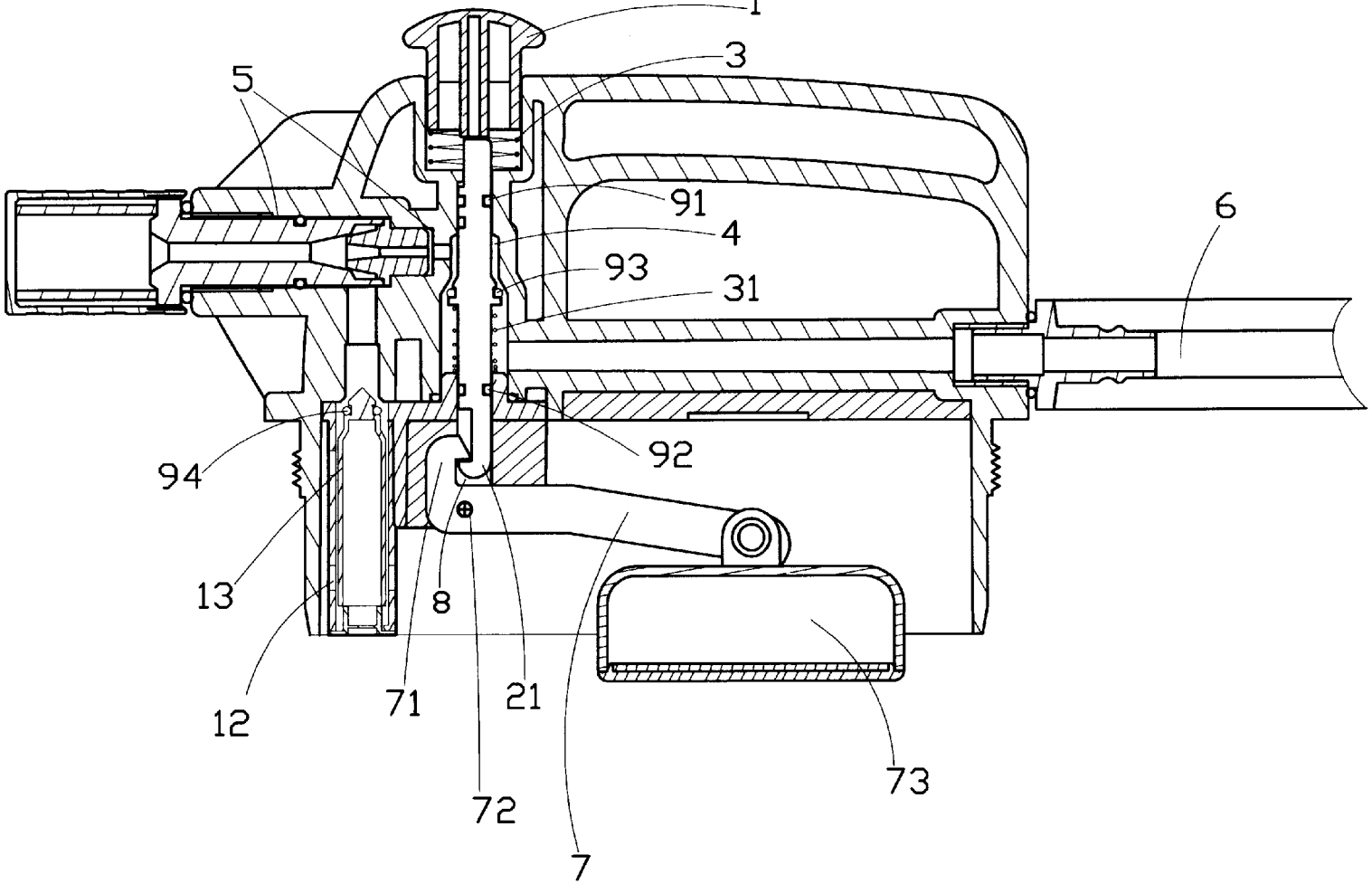
FIG. 1 is a sectional view of an oil suction pump according to the present invention.
Figure 5:
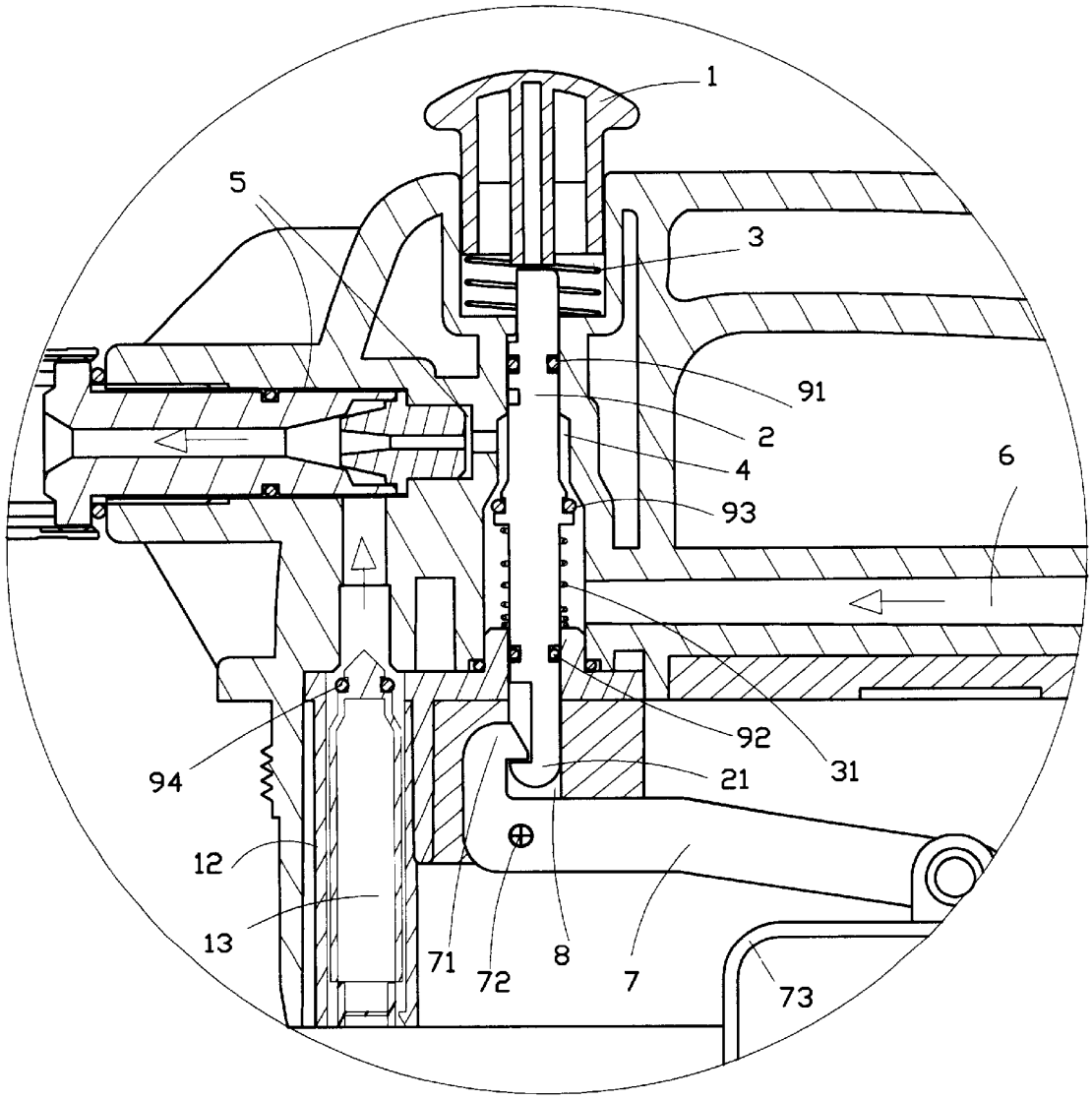
FIG. 5 is a partially enlarged view of FIG. 1.

Please refer to FIG. 1 that is a sectional view of an oil suction pump according to the present invention, and to FIG. 5 that is a partially enlarged view of FIG. 1. As shown, the oil suction pump includes a push switch 1, a shaft 2 located below the push switch 1, a first compression spring 3 provided around an upper portion of the shaft 2 for the push switch 1 to be elastically moved downward within a predetermined range, and an enclosed passage 4 for receiving the shaft 2 therein.

The enclosed passage 4 has an open upper end communicating with the push switch 1 and is communicable at two opposite sides with an air outlet pipe 5 and an air inlet pipe 6. An open lower end of the enclosed passage 4 communicates with a slide way 8, in which a first end of a float arm 7 is located.

First and second airtight seal rings 91, 92 are provided near upper and lower ends, respectively, of the shaft 2, so that the shaft 2 located in the enclosed passage 4 is always in an airtight relation with the enclosed passage 4 near the upper and the lower end of the shaft 2. A third airtight seal ring 93 is provided near a middle portion of the shaft 2. When the shaft 2 is vertically moved in the enclosed passage 4, the third seal ring 93 is also moved to different height to either close or open a communicating path between an inner end of the air outlet pipe 5 and the enclosed passage 4. A second compression spring 31 is provided near the middle portion of the shaft 2 to control a magnitude of vertical movement of the shaft 2 in the enclosed passage 4. More particularly, the enclosed passage 4 includes a downward flared portion in its inner bore. When the shaft 2 is not downward moved to compress the second compression spring 31, the third airtight seal ring 93 on the shaft 2 is just located at a height to firmly abut against the flared portion of the enclosed passage 4 and therefore seals the communicating path between the enclosed passage 4 and the air outlet pipe 5. And, when the shaft 2 is moved downward to compress the second compression spring 31, the third airtight seal ring 93 is also moved downward to separate from the flared portion of the enclosed passage 4 for the air outlet pipe 5 to communicate with the enclosed passage 4.

The shaft 2 has a lower end in the form of a hook 21. The hook 21 is located in the slide way 8 to detachably engage with a hook 71 provided at the first end of the float arm 7 horizontally located below the lower end of the shaft 2. The float arm 7 is pivotally turnable about a supporting point 72 provided close to and below the hook 71. A second end of the float arm 7 is pivotally connected to a float 73. When the oil suction pump of the present invention is connected to a container 10 for sucking oil 11 there into (see FIGS. 2 to 4), the float 73 ascends when the oil 11 reaches a predetermined level in the container 10.

The oil suction pump of the present invention may also be internally provided with an air drawing passage 12 to communicate with the air outlet pipe 5. A floating member 13 is provided in the air drawing passage 12 as an auxiliary means to control the air outlet pipe 5. The floating member 13 has a diameter-reduced neck portion provided near an upper end thereof, and a fourth airtight seal ring 94 is provided around the neck portion. When the oil 11 sucked into the container 10 reaches such a level to move the floating member 13 upward, the fourth airtight seal ring 94 is also moved upward to close the air drawing passage 12 and therefore prevents the oil 11 from flowing into and jetting out via the air outlet pipe 5. Since the air drawing passage 12 is not a subject matter of the present invention, it is not discussed in details herein.

Figure 2:
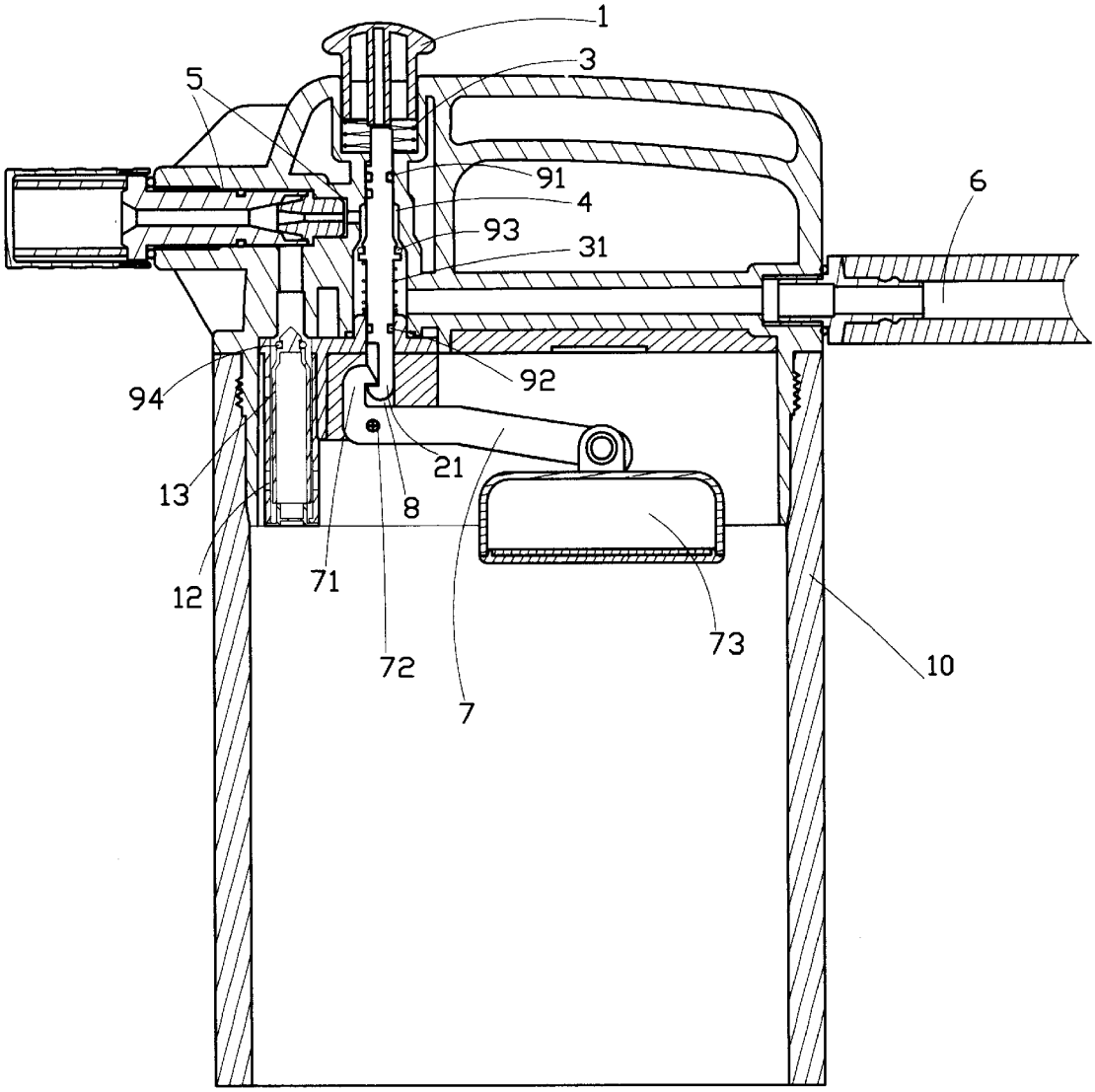
FIGS. 2 to 4 are sectional views showing the operation of the oil suction pump of the present invention.
Figure 3:
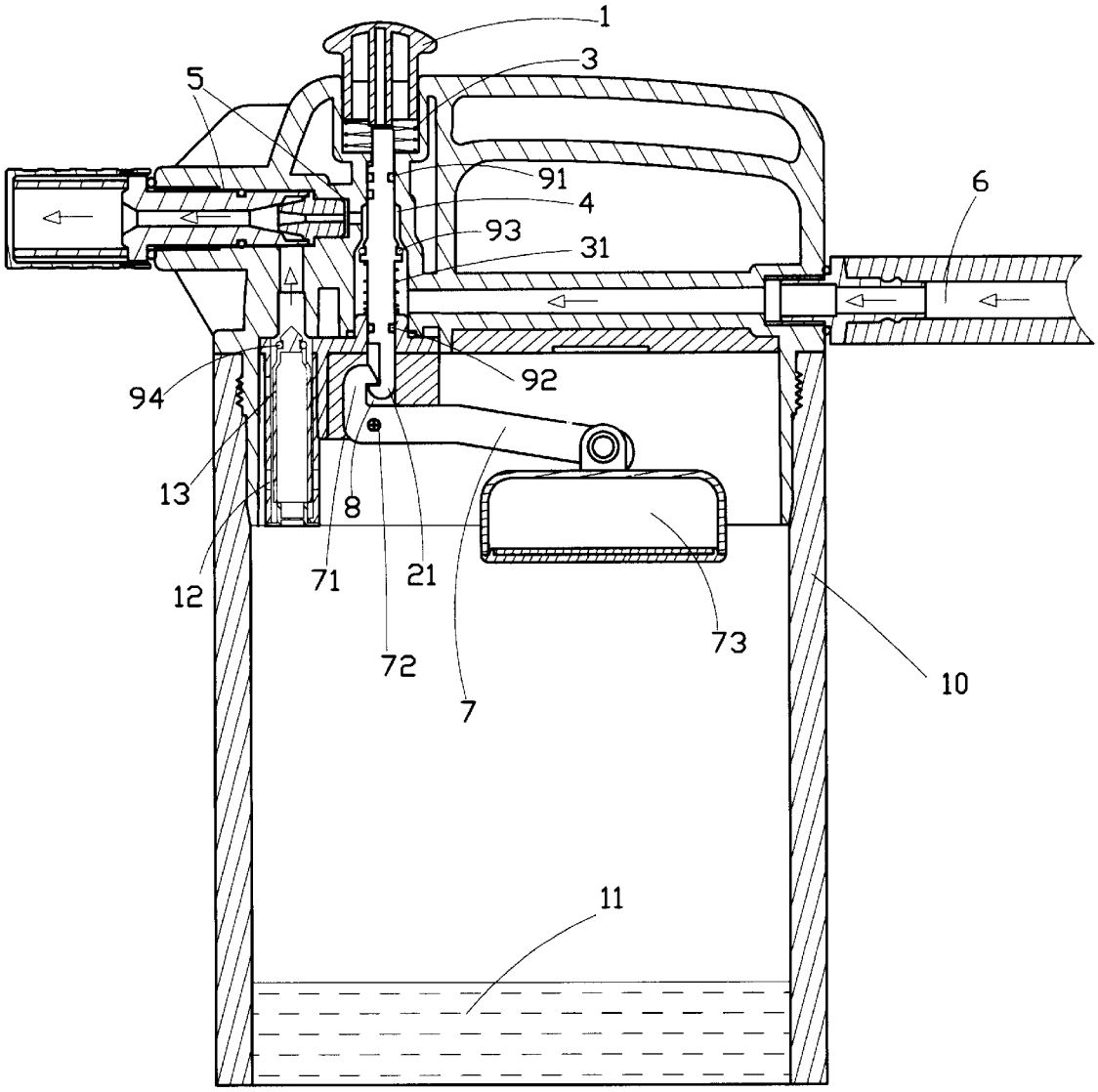
Figure 4:
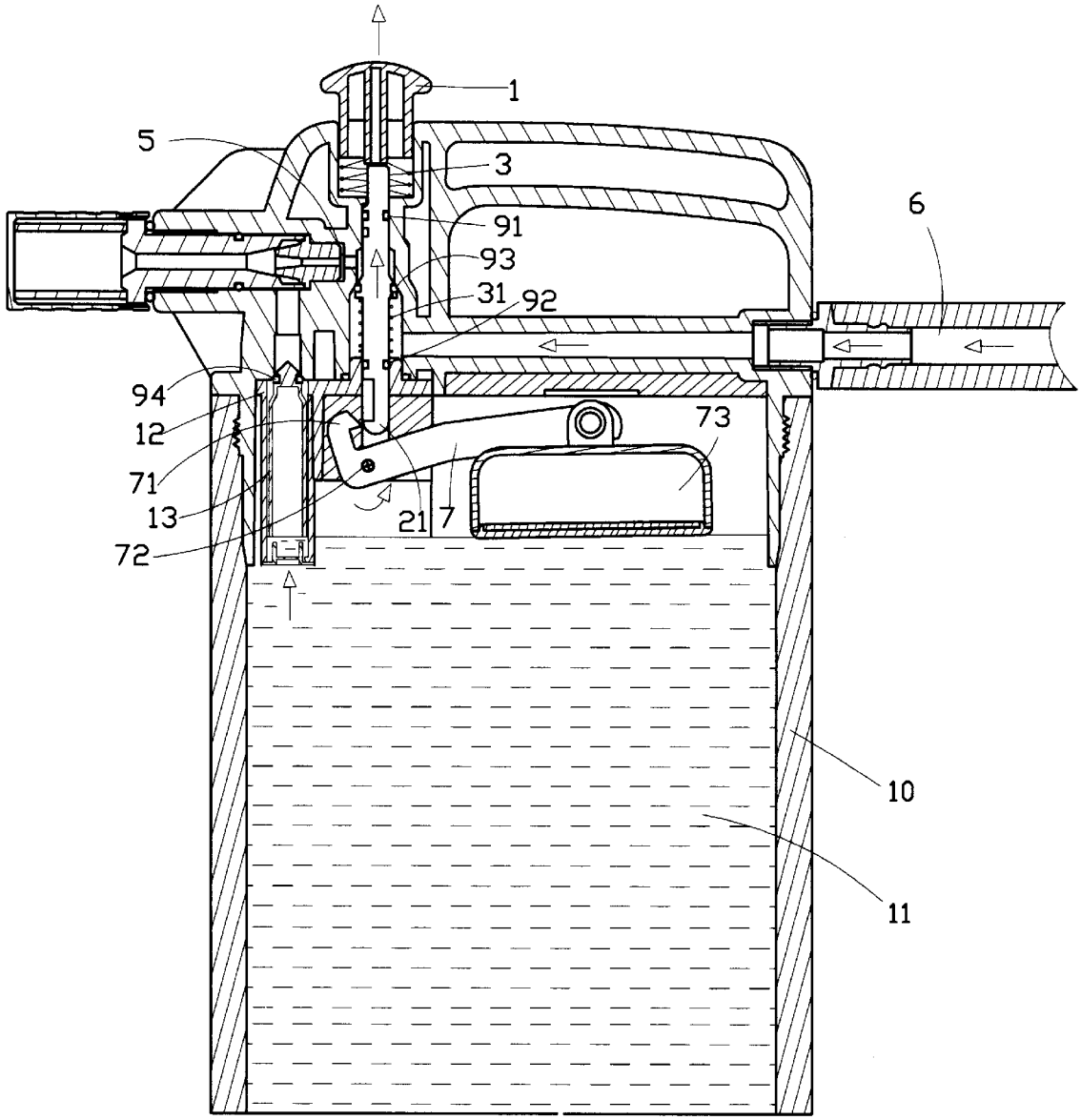

Please refer to FIGS. 2 to 4 that shows the operation of the present invention. The push switch 1 may be depressed to move the shaft 2 downward in the enclosed passage 4. At this point, the third airtight seal ring 93 provided near the middle portion of the shaft 2 is also moved downward to separate from the flared portion of the enclosed passage 4. When the shaft 2 is moved downward to finally engage the hook 21 at its lower end with the hook 71 at the first end of the float arm 7, both the first and the second compression springs 3, 31 are in a compressed state. Since the third airtight seal ring 93 is separated from the flared portion of the enclosed passage 4, compressed air may be supplied from an air compressor (not shown) to the enclosed passage 4 via the air inlet pipe 6, and then flows through the opened flared portion of the enclosed passage 4 to the air outlet pipe 5 and be released from the oil suction pump. This operation produces a vacuum in the container 10 and therefore enables suction of oil 11 into the container 10.

When the oil 11 sucked into the container 10 reaches a predetermined level and causes the float 73 to ascend, the float arm 7 pivotally turns about the supporting point 72 and the hook 71 descends as a result of leverage. The descent hook 71 disengages from the hook 21 of the shaft 2 and therefore allows the push switch 1 and the shaft 2 to move upward under a restoring force of the previously compressed first and second compression springs 3 and 31, respectively, to their respective original positions with the third airtight seal ring 93 pressing against the flared portion of the enclosed passage 4 again to close the communicating path between the air outlet pipe 5 and the enclosed passage 4. At this point, air supplied into the oil suction pump via the air inlet pipe 6 no longer flows to the air outlet pipe 5 via the enclose passage 4, and an air inlet valve of the oil suction pump is therefore automatically closed.

What is claimed is:

1. An oil suction pump, comprising:

a pump means having an air inlet pipe and an air outlet pipe;

an enclosed passage having an upper end and an open lower end;

a push switch operably disposed in said enclosed passage upper end;

a shaft vertically disposed below said push switch within said enclosed passage, said shaft having a first end and a second end;

a float arm having a first end and a second end and pivotally mounted below said shaft at a pivot support, wherein said first end of said float arm is detachably engageable with said second end of said shaft when said push button is depressed;

a float disposed at said second end of said float arm, wherein said float is raised when the oil level is increased, and wherein said first end of said float arm disengages from said second end of said shaft.

2. The oil suction pump of claim 1, further comprising a first compression spring disposed between said first end of said shaft and said push switch, and a second compression spring disposed in a middle portion of said shaft.

3. The oil suction pump of claim 1, wherein said enclosed passage open lower end communicates with a slideway for said first end of said float arm, and wherein said air inlet pipe and said air outlet pipe communicate with two opposite sides of said enclosed passage.

4. The oil suction pump of claim 3, further comprising a first airtight seal ring disposed on said shaft proximate said first end of said shaft, a second airtight seal ring disposed on said shaft proximate said second end of said shaft, and a third airtight seal ring disposed on said shaft intermediate said first end and said second of said shaft.

5. The oil suction pump of claim 4, wherein said second end of said shaft is hook-shaped.

6. The oil suction pump of claim 1, wherein said first end of said float arm is hook-shaped.

* * * * *